United States Patent [19]

Obara

[11] Patent Number: 4,516,948

[45] Date of Patent: May 14, 1985

[54] RECONFIGURABLE TOY ASSEMBLY

[75] Inventor: Hiroyuki Obara, Tokyo, Japan

[73] Assignee: Takara Co., Ltd., Tokyo, Japan

[21] Appl. No.: 584,460

[22] Filed: Feb. 28, 1984

[30] Foreign Application Priority Data

Sep. 22, 1983 [JP] Japan ..... 58-146785[U]

[51] Int. Cl.[3] ..... A63H 17/00

[52] U.S. Cl. ..... 446/95; 446/97; 446/376; 446/434; 446/487

[58] Field of Search ..... 446/95, 94, 93, 97, 446/99, 268, 376, 431, 433, 434, 465, 470, 478, 487

[56] References Cited

U.S. PATENT DOCUMENTS

| | | | |
|---|---|---|---|
| 4,206,564 | 6/1980 | Ogawa | 446/94 |
| 4,382,347 | 5/1983 | Murakami | 446/433 |
| 4,391,060 | 7/1983 | Nakane | 446/94 |
| 4,435,916 | 3/1984 | Iwao et al. | 446/470 |

*Primary Examiner*—Mickey Yu

*Attorney, Agent, or Firm*—Jackson, Jones & Price

[57] ABSTRACT

A reconfigurable toy assembly having foldable portions to allow the toy assembly to simulate a toy combination vehicle having a tractor unit and a trailer unit separatably connected to each other. The tractor unit when separated from the trailer unit is reversibly reconfigurable into a robotic humanoid form, while the trailer unit is reversibly reconfigurable into a play space for the robotic humanoid.

11 Claims, 7 Drawing Figures

RECONFIGURABLE TOY ASSEMBLY

BACKGROUND OF THE INVENTION

1. Field of the Invention

The present invention relates to a reconfigurable toy assembly, and more particularly, to a reconfigurable toy assembly wherein a toy vehicle, formed by separatably combining a tractive unit and a trailer section, is constructed such that it is possible to reversibly reconfigure the tractive unit and the trailer section into a toy robotic humanoid and a play space, respectively.

2. Description of the Prior Art

Such reconfigurable toy assemblies of this type have recently been proposed and put into practical use that toy cars simulating a bus, truck and the like are reconfigured into a toy house, toy robotic humanoid and the like. However, any of these reconfigurable toy assemblies can be reconfigured into only one kind of thing; hence, the play with such a reconfigurable toy assembly may be apt to be monotonous.

SUMMARY OF THE INVENTION

In view of the above, it is an object of the invention to provide a reconfigurable toy assembly wherein a toy vehicle is reversibly reconfigured into a toy robotic humanoid and a play space, the assembly comprising the following requirements;

(a) the toy vehicle constituted by a combination of a tractive unit and a trailer section, which are separatably connected to each other and adapted to form a toy vehicle in the connected state; and (b) the tractive unit being adapted to be foldable as well as pivotal at proper portions thereof so as to be reversibly reconfigured into the toy robotic humanoid, while the trailer section being adapted to open and close at proper portions thereof and having therein an unfoldable play space to be used for a play with the toy robotic humanoid.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

DETAILED DESCRIPTION OF THE PREFERRED EMBODIMENT

The following description is provided to enable any person skilled in the toy industry to make and use the present invention and sets forth the best modes contemplated by the inventor for carrying out his invention. Various modifications, however, will remain readily apparent to those skilled in the art, since the generic principles of the present invention have been defined herein specifically to provide a novel reconfigurable toy assembly.

Figure 1:
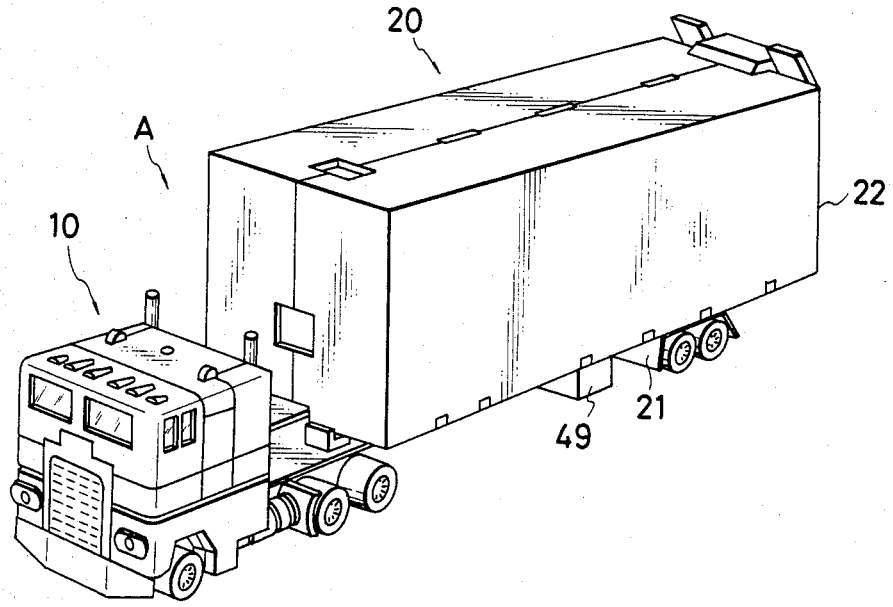
FIG. 1 is a perspective view of an embodiment of the reconfigurable toy assembly in accordance with the invention.

Referring to FIG. 1, a reference symbol A denotes a reconfigurable toy assembly. This reconfigurable toy assembly A simulates a heavy-duty truck, which is constituted by a combination of an tractive unit 10 and a trailer section 20. The tractive unit 10 is adapted to be reversibly reconfigured into a toy robotic humanoid, while the trailer section 20 is adapted to be unfolded into a space station.

Figure 2:
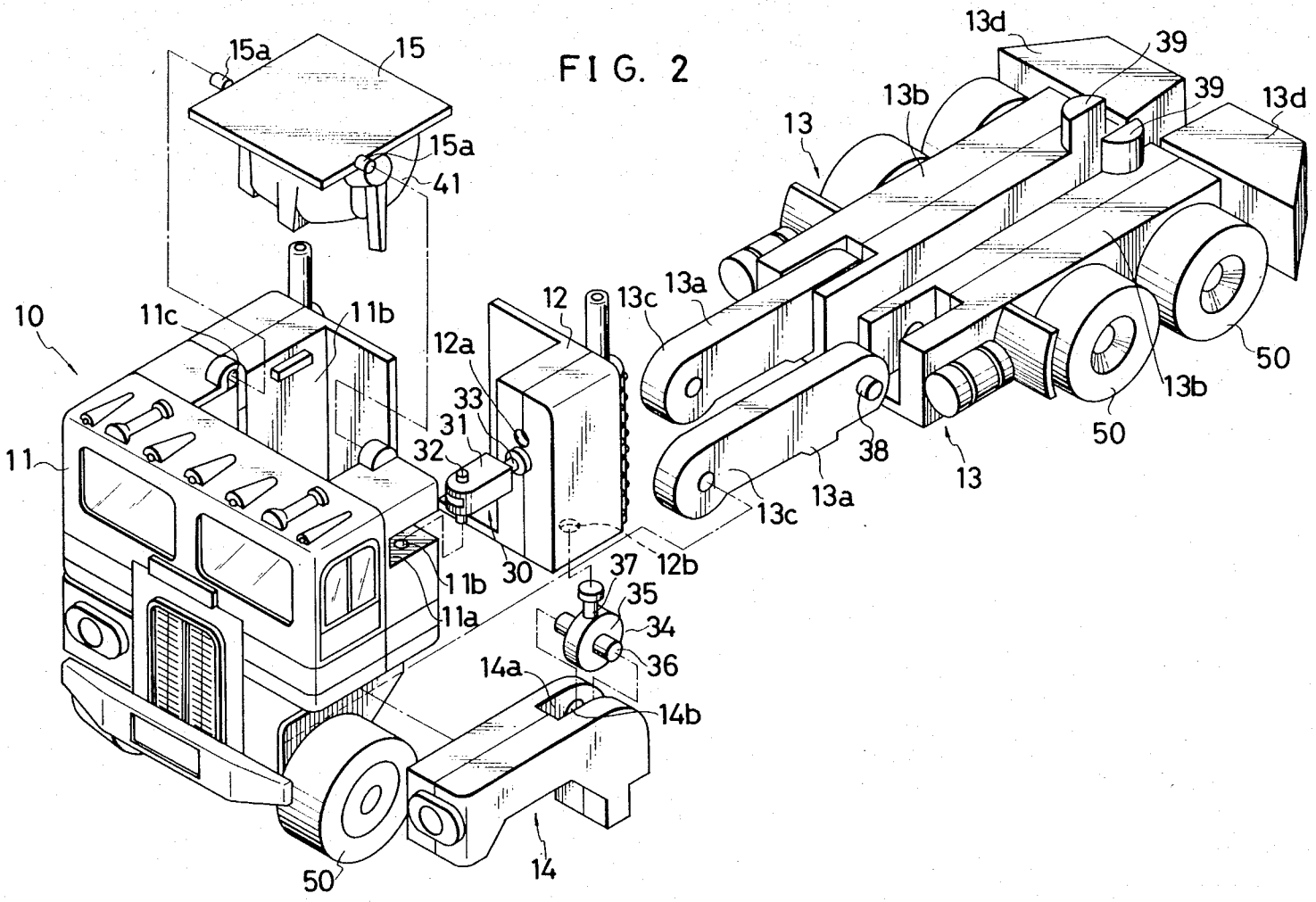
FIG. 2 is an exploded perspective view of a tractive unit of the embodiment of FIG. 1.

As shown in FIG. 2, the tractive unit 10 is composed of: a tractive unit body 11 having front wheels as well as a control cabin formed in the shape of mission control; a pair of tractive unit rear members 12, 12 sideward pivotally connected to the rear part of the tractive unit body 11; a pair of chassis members 13, 13 downward pivotally connected to the lower part of the tractive unit body 11; and a cover panel 15 180° pivotally connected to the upper part of the tractive unit body 11. In addition, fender members 14, 14 are pivotally connected to the rear members 12, 12, respectively.

The above-mentioned members constituting the tractive unit 10 will be described hereinunder in more detail. First of all, the rear members 12, 12 are formed so as to in combination constitute the rear part of the tractive unit 10 and are pivotally connected to the body of the tractive unit 10 through connecting members 30, respectively. More specifically, each connecting member 30 is constituted by a base piece 31 having two pivots 32, 33 projecting in the respective directions perpendicular to each other. The base piece 31 is housed within a corresponding one of recesses **11*a* provided on either side of the rear part of the tractive unit body 11. One pivot 32 is pivotally fitted in bearing portions 11*b* formed in the upper and lower inner walls of the recess 11*a*, while the other pivot 33 is pivotally fitted in a hole 12*a* in a side wall of the corresponding rear member 12. Thus, the rear member 12, 12 are allowed to be sideward pivotal about the respective pivots 32 as well as clockwise and counter-clockwise pivotal about the respective pivots 33 with respect to the tractive unit body 11. In addition, the fender members 14, 14 are pivotally mounted on the lower end portions of the rear members 12, 12 through connecting members 34, respectively. Each connecting member 34 is also constituted by a base 35 having pivots 36, 37 projecting in the respective directions perpendicular to each other. The base 35 is housed in a recess 14*a* provided in a corner of the rear part of the fender member 14. One pivot 36 is pivotally fitted in bearing portions 14*b* formed in the opposing inner walls of the recess 14*a*, while the other pivot 37 is pivotally fitted in a bearing portion 12*b* formed in the lower end portion of the rear member 12. Thus, the fender members 14, 14 are allowed to be sideward pivotal about the respective pivots 37 as well as vertically pivotal about the respective pivots 36. Moreover, the tractive unit body 11 has an opening 11*b* formed in the roof portion thereof. The cover panel 15 is 180° pivotally provided in the opening 11*b*. More specifically, the cover panel 15 has pivots 15*a*, 15*a* projecting from both sides thereof. These pivots 15*a*, 15*a* are fitted in bearing portions 11*c* provided at the opposing portions of the opening 11*b*, respectively. In addition, the cover panel 15 has a robotic humanoid head 41 secured to the rear side thereof. Thus, when the surface of the cover panel 15 is exposed to the outside, the head 41 is housed in the inner space of the tractive unit body 11. On the other hand, when the cover panel 15 is rotated 180° about the pivots 15***a*, the robotic humanoid head 41 appears to the outside.

Figure 3:
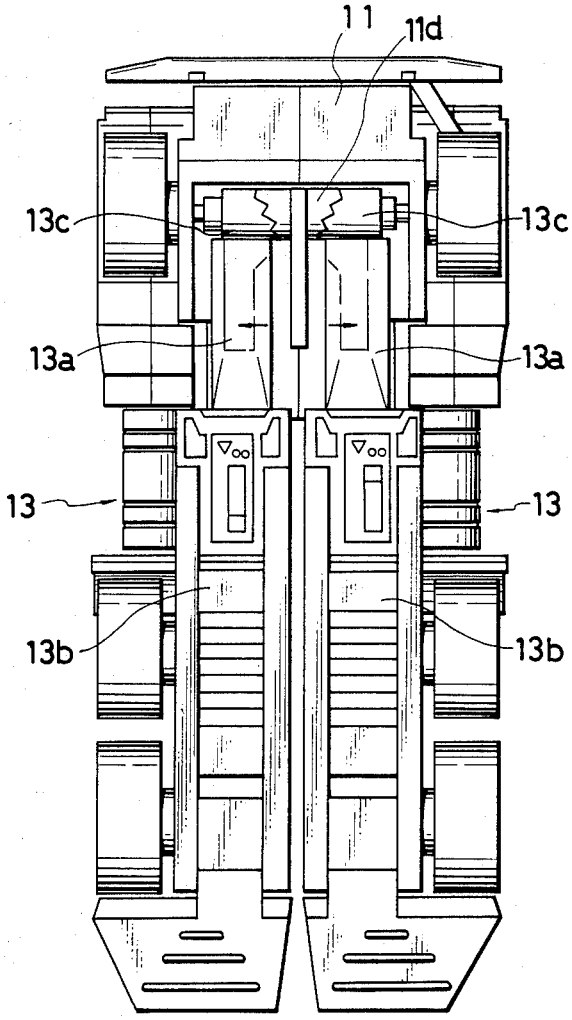
FIG. 3 is a bottom view of the tractive unit.

Next, the chassis is constituted by a pair of chassis members 13, 13. Each chassis member 13 is composed of a front member 13*a* and a rear member 13*b* which are connected so as to be foldable to some extent about a pivot 38. The front member 13*a* has a bearing 13*c* formed in its free end portion and is downward pivotally fitted on the front axle provided at the lower end portion of the tractive unit body 11. On the other hand, the rear member 13*b* has central wheels 50, which are rotatably provided, and a connecting shaft 39 projected from the upper part of its free end portion. In addition, a chassis rear end member 13*d* is pivotally attached to the rear part of the rear member 13*b*. The connecting shafts 39, 39 are in combination fitted into a bearing hole (not shown) provided in the undersurface of the trailer section 20. It is to be noted that the chassis members 13, 13 are housed in the tractive unit body 11 as a substantially one unit and are adapted to separate from each other when pivoting downwardly. More specifically, as shown in FIG. 3, the tractive unit body 11 has an axle bearing portion 11*d* formed in the center of its lower part, and the side surfaces of the bearing portions 13*c* of the chassis front members 13*a* are in slide contact with the side surfaces of the bearing portion 11*d*, respectively. The lower end part of the bearing portion 11*d* of the tractive unit body 11 is formed so as to diverge from the rear part toward the front part thereof, and the bearing portions 13*c*, 13*c* of the chassis front members 13*a*, 13*a* are in slide contact with the side surfaces of the bearing portion 11*d*, respectively. Therefore, when the chassis members 13, 13 pivot downwardly (upwardly as viewed in FIG. 3), the bearing portions 13*c*, 13*c* are pushed sideward, as shown by arrows, by the corresponding side surfaces of the bearing portion 11*d* so as to separate from each other. It is to be noted that to restore the bearing portion 13*c*, 13*c* to the former state after pivoting, it is preferable to arrange such that a proper guide member is provided on the tractive unit body 11 thereby to house both the chassis members 13, 13 in the body 11 in one unit.

Figure 4:
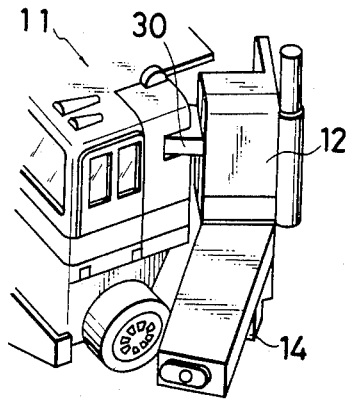
FIG. 4 illustrates how the tractive unit is reconfigured.
Figure 5:
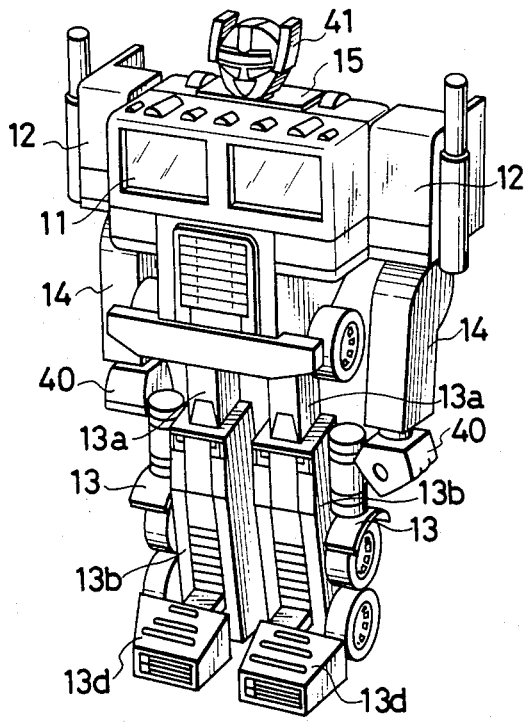
FIG. 5 is a perspective view of the tractive unit in the state where it is reconfigured into a toy robotic humanoid.

The tractive unit 10 is adapted to be foldable as well as pivotal as mentioned above. Therefore, first of all, as shown in FiG. 4, each rear member 12 is sideward pivoted, and then the fender member 14 connected to the lower end of the rear member 12 is sideward pivoted and downward stretched. Then, a hand member 40 (see FIG. 5), formed separately, is fitted into a hole formed in the front end (i.e. the headlight postion) of the fender member 14. Next, the cover member 15 is pivoted 180° to allow the head 41, formed on the reverse surface thereof, to appear on the upper part of the tractive unit 10. Moreover, the two chassis members 13, 13 are downward pivoted about 90°, and the rear end members 13*d*, 13*d* at the ends of the chassis members 13, 13, respectively, are substantially pivoted about 90°. By thus moving the various parts, the tractive unit 10 is reconfigured into a toy robotic humanoid, as shown in FIG. 5, which has: a trunk constituted by the tractive unit body 11; the head 41 on the cover member 15; upper arms and lower arms constituted by the rear members 12, 12 and the fender members 14, 14, respectively; legs constituted by the chassis members 13, 13, respectively; and feet constituted by the rear end members 13*d*, 13*d* at the ends of the chassis members 13, 13, respectively. Moreover, the chassis front members 13*a*, 13*a* and rear members 13*b*, 13*b* are adapted to constitute thigh portions and shank portions, respectively which are foldable at the respective connections. An accessory hand member 40 can be attached to the end of each fender member 14. Accordingly, it is possible to enjoy a play with the assembly as a toy robotic humanoid after the reconfiguration.

It is to be noted that in a practical form to reconfigure the tractive unit 10 into a toy robotic humanoid, it is possible to obtain any of toy robotic humanoids having various configurations according to various factors as follows: the configuration of the tractive unit 10; how any portion of the tractive unit 10 is constructed so as to be splitable; how a splitable constituent member is connected to other member; and in which direction the connected member is allowed to pivot. However, only the above-mentioned configuration is shown herein.

Figure 6:
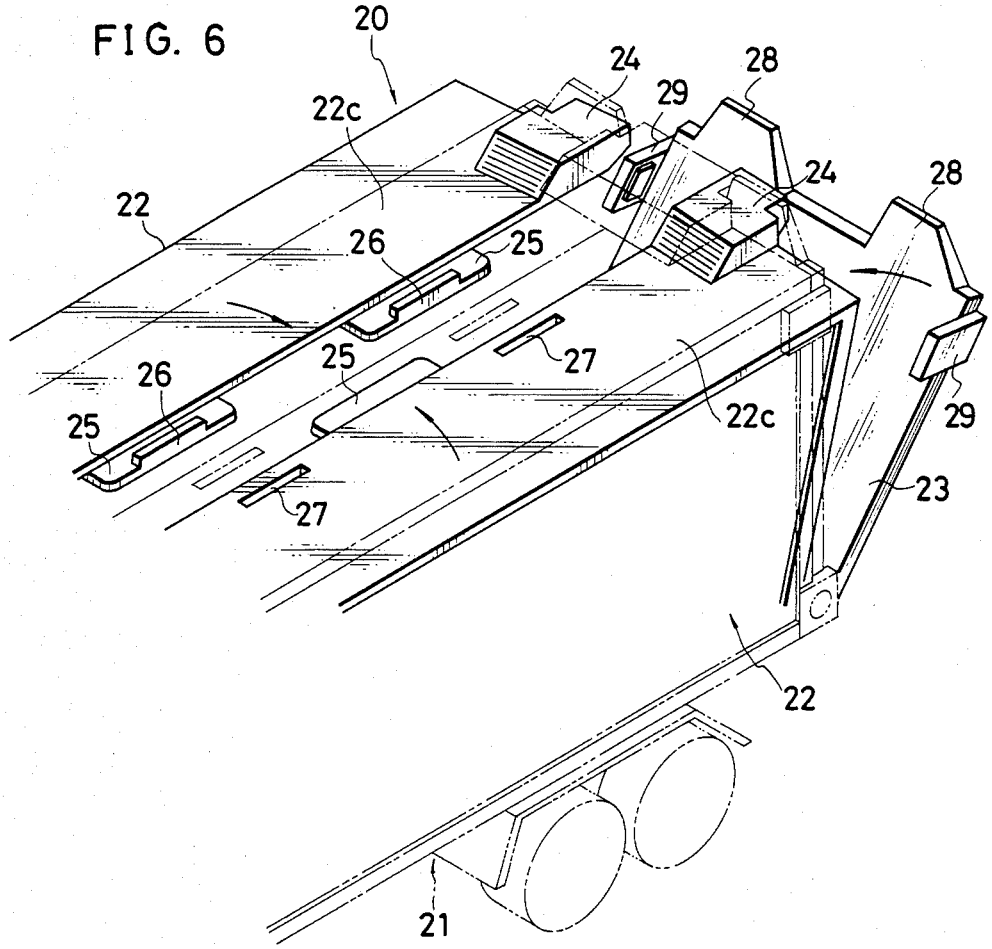
FIG. 6 illustrates how a trailer section is opened and closed.
Figure 7:
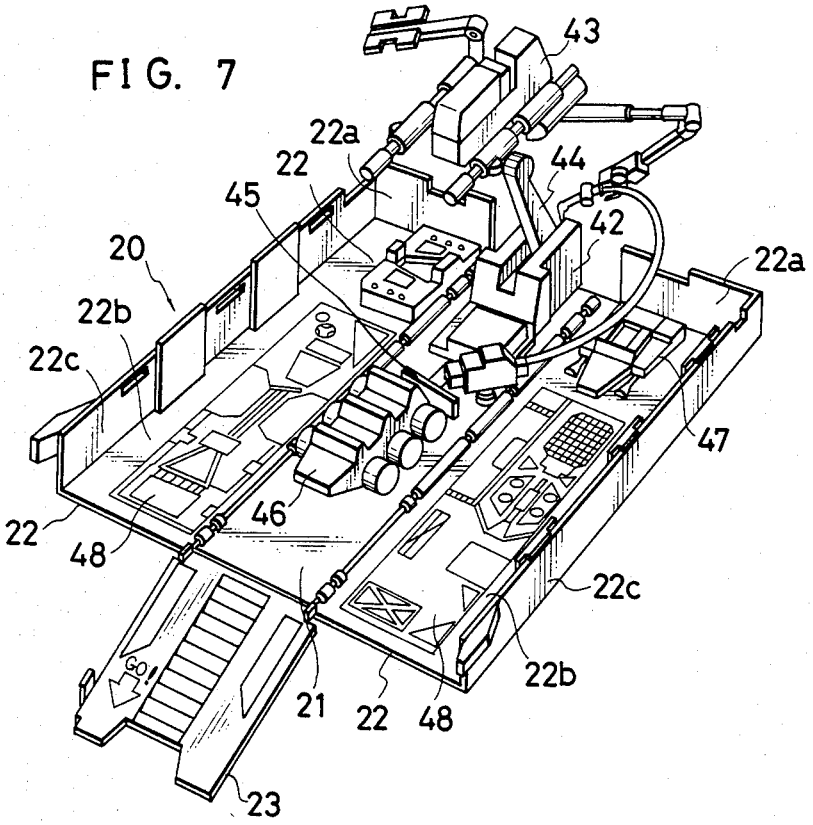
FIG. 7 shows the trailer section in the unfolded state.

Next, referring to FIGS. 6 and 7, the trailer section 20 is formed into a box-like shape and is composed of: a base 21 equipped with wheels; and a pair of right and left front frame members 22, 22 provided on the base 21 and each having a front frame portion 22*a*, a side frame portion 22*b* and an upper frame portion 22*c*; and a rear frame 23 provided on the base 21. The proximal part of the side frame portion 22*b* and that of the rear frame 23 are pivotally attached to a side end part and a rear end part of the base 21 through hinges (not shown), respectively. In addition, as shown in FIG. 6, a projection 24 is formed rearwardly of the rear end of the upper frame portion 22*c* fo each of the right and left front frame members 22. Further, projecting pieces 25, 25 are formed on the abutments of the upper frame portions 22*c*, 22*c*, respectively, so as to be alternate with each other. Furthermore, the projecting pieces 25 of one of the front frame members 22 are provided with engaging projections 26, respectively, while the abutting portions of the other front frame member 22 corresponding to the projecting pieces 25 are provided with engaging retainers 27, respectively. Thus, the right and left front frame members 22 can pivot about the respective hinges to open and close, rightwardly and leftwardly, on the base 21. When they are closed, the engaging projections 26 formed on the projecting pieces 25 of one of the front frame members 22 and the engaging retainers 27 of the projecting pieces 25 of the other front frame member 22 are engaged with each other to prevent the front frame members 22 from opening. At this time, the projecting pieces 25, 25 of both the front frame members 22, 22 abut on the undersurfaces of the ends of the upper frame portions 22 of their counterparts to support from the lower side as well as maintain the engagement between the engaging projections 26 and the engaging retainers 27 in an excellent condition.

In addition, the rear frame 23 has upward projections 28 formed at both ends of the upper part thereof, and forward projections 29, 29 formed on both sides thereof. Accordingly, also the rear frame 23 can be opened and closed as desired through a hinge. When the rear frame 23 is closed after both of the front frame members 22 are closed, the projections 24, 24 of the front frame members 22 are engaged between the projections 28, 28 formed on the upper part of the rear frame 23, and moveover, the projections 29 formed on both sides of the rear frame 23 are engaged with the side frame portions 22*b* of the front frame members 22, respectively. Therefore, the front frame members 22 are clamped at their upper and side parts by the rear frame 23 so as to be locked in the closed state.

Next, as shown in FIG. 7, various members are disposed in the interior defined by the base 21, the front frame members 22 and the rear frame 23, which in combination constitute the trailer 20. More specifically, the upper surface of the base 21 is formed so as to simulate a runway and has a landing pad 42 mounted on its end portion. The landing pad 42 has a battle means 43 mounted thereon through a crane 44. In addition, the landing pad 42 is provided at its lower end portion with a launching member 45 driven longitudinally forward of the runway by means of a spring. The launching member 45 is adapted to be released from engagement by operating a proper operating member, not shown, so as to be forwardly driven by the spring force. In relation thereto, it is possible to launch a toy vehicle 46, such as a space probe vehicle, by means of the launching member 45. Further, a member 47, similarly simulating a space structure or accessory, is attached to also the inner wall of the side frame portion 22*b* of each front frame member 22. In addition, a metl sheet 48 is stretched over the inner wall surface of each side frame portion 22*b*, and the surface of the metal sheet 48 is patterned with space environments. Furthermore, the reverse surface of the rear frame 23 is also patterned with a part of the runway. It is to be noted that the backing with the metal sheet 23 allows each side frame portion 22*b* to be reinforced.

Moreover, the trailer section 20 has a bearing hole (not shown) formed in the front undersurface thereof, which is fitted with the connecting shafts 39, 39 of the tractive unit 10 as mentioned above to connect the tractive unit 10 and the trailer section 20 thereby to constitute the heavy-duty truck A. It is to be noted that if retainer members 49, as shown in FIG. 1, for retaining the front frame members 22 are attached to both sides of the base 21, respectively, so as to be sideward pivotal or drawable, when the front frame members 22 are opened, they can be continuously supported on the same plane.

As described above, the trailer section 20 is adapted to constitute a heavy-duty truck as well as provide therein a play space simulating a space station by unfolding the right and left front frame members 22 and the rear frame 23. Therefore, it is possible to enjoy a variety of plays, together with the toy robotic humanoid formed by reconfiguring the tractive unit 10.

It is also to be noted that the trailer section 20 is not necessarily limitative to the example in the above-described embodiment in which it is unfolded to constitute the space station-like play space, and it is only necessary for the trailer section 20 to define a proper space which allows children to play with the toy robotic humanoid.

As described above, the heavy-duty truck is constituted by a combination of the tractive unit 10 and the trailer section 20, and the tractive unit 10 is reconfigured into the toy robotic humanoid, while the trailer section 20 is unfolded to constitute the space station-like play space. Therefore, it is possible to enjoy not only a truck play but also a play with the toy robotic humanoid together with the space station by reconfiguring the tractive unit 10 and the trailer section 20; hence, a single reconfigurable toy assembly provides two plays totally different from each other.

It is to be noted that although according to the above-described embodiment the heavy-duty truck is reconfigured into a toy robotic humanoid and a play space when unfolded, the truck is not exclusive and any toy vehicle may be employed, for example, a toy bus, toy train and toy airplane.

As has been described in detail, the reconfigurable toy assembly in accordance with the invention is constructed such that the toy vehicle constituted by a combination of the tractive unit and the trailer section is reversibly reconfigured into the toy robotic humanoid and the play space therefor. Therefore, it is possible to enjoy a variety of plays by reconfiguring the various parts of the toy vehicle, so that the toy assembly is rich in unexpectedness. In addition, the toy assembly of the invention facilitates the rearrangement thereof, since the toy robotic humanoid and the play space used therewith are rearranged by being restored into a single toy vehicle.

What is claimed is:

1. A reconfigurable toy assembly wherein a toy vehicle is reversibly reconfigured into a toy robotic humanoid and a play space, said assembly comprising:

a tractive unit; and a trailer section; said tractive unit and trailer section being separatably connected to each other and adapted to form said toy vehicle in the connected state, and said tractive unit being adapted to be foldable and pivotal at proper portions thereof so as to be reversibly reconfigured into said toy robotic humanoid, while said trailer section being adapted to open and close at proper portions thereof and having therein an unfoldable play space to be used for a play with said toy robotic humanoid.

2. The invention of claim 1 wherein the tractive unit includes a frame body having a pair of front wheels, a cabin member pivotally mounted to the frame body, a pair of tractive unit rear members pivotally connected to the frame body, a pair of fender members respectively movably connected to the tractive unit rear members, a pair of chassis members pivotally connected to the frame body, and a robotic humanoid head member movably mounted to the frame body, the tractive unit when reconfigured into a toy robotic humanoid has the cabin member forming a portion of a robotic trunk, the tractive unit rear members and fender members forming the robotic humanoid arms, the chassis member forming the robotic humanoid legs and the head member is moved to a position above the cabin member.

3. The invention of claim 1 wherein the trailer section includes a base section and a pair of frame members are pivotally mounted to the base section, the frame members are capable of pivotal movement to lie in a plane containing the surface of the base section to provide a play space.

4. The invention of claim 2 wherein the chassis members further include respective pivotally mounted rear chassis members that can be pivoted to form the supporting feet of the robotic humanoid configuration.

5. The invention of claim 2 wherein each chassis member supports at least one wheel.

6. The invention of claim 2 wherein the trailer section has a bearing hole and each chassis member provides half of a connecting shaft for interconnecting the tractive unit withe the bearing hole.

7. The invention of claim 2 wherein the trailer section includes a base section and a pair of frame members pivotally mounted to the base section, the frame members are capable of pivotal movement to lie in a plane containing the surface of the base section to provide a play space.

8. The invention of claim 3 wherein a launching member is mounted on the play space and is capable of propelling accesory vehicles.

9. The invention of claim 3 wherein an extendable crane assembly is mounted on the base section.

10. The invention of claim 3 wherein at least one metal sheet is mounted on the surface of a frame member adjacent the surface of the base member.

11. The invention of claim 7 wherein a launching member, capable of propelling accessory vehicles, and an extendable crane assembly are mounted on the play space.

* * * * *